US005171133A

United States Patent [19]

Thomas

[11] Patent Number: 5,171,133

[45] Date of Patent: Dec. 15, 1992

[54] FUEL PUMP HAVING AN ADJUSTABLE SPRING CLIP TO REGULATE FLOW

[75] Inventor: Gerald S. Thomas, Gloucester, England

[73] Assignee: Lucas Industries, England

[21] Appl. No.: 705,933

[22] Filed: May 28, 1991

[30] Foreign Application Priority Data

Jun. 8, 1990 [GB] United Kingdom ..... 9012848

[51] Int. Cl.[5] ..... F04B 7/04; F04B 39/10; F02M 59/20

[52] U.S. Cl. ..... 417/499; 123/503

[58] Field of Search ..... 123/503, 509, 495; 417/494, 499

[56] References Cited

U.S. PATENT DOCUMENTS 4,571,161 2/1986 LeBlanc et al. ..... 123/509

FOREIGN PATENT DOCUMENTS 0219349 1/1962 Austria ..... 417/494

0159461 6/1989 Japan ..... 123/495

*Primary Examiner*—Richard A. Bertsch

*Assistant Examiner*—Roland McAndrews

*Attorney, Agent, or Firm*—Andrus, Sceales, Starke & Sawall

[57] ABSTRACT

A reciprocable plunger fuel injection pump has a pump body and a plunger slidable in a bore in the body. The plunger is coupled to an arm extending outwardly from the body and movable about the axis of the plunger in order to vary the angular setting of the plunger. A spring clip partly embraces a cylindrical portion of the pump body. The clip defines an abutment surface for engagement by the arm to set the arm and plunger at a predetermined angular position.

3 Claims, 2 Drawing Sheets

FUEL PUMP HAVING AN ADJUSTABLE SPRING CLIP TO REGULATE FLOW

This invention relates to a fuel injection pump for supplying fuel to an internal combustion engine and of the kind comprising a pump body, a bore defined in the pump body, an outlet from one end of the bore, a pumping plunger slidable in the bore and extending from the other end thereof, a spill port formed in the wall of the bore and an inclined control edge formed on the plunger, a fuel control arm extending laterally from the pump body, the arm being angularly adjustable about the axis of the plunger, means coupling the arm to the plunger whereby the angular setting of the plunger can be adjusted and resilient means biasing the plunger in the direction away from said one end of the bore.

Such a pump is intended to be mounted on an associated engine with the outlet connected to a fuel injection nozzle of the engine. The plunger is actuated by an engine driven cam either directly or indirectly through a rocker, and the fuel control arm is connected to an output member of a governor mechanism along with the control arms of other pumps which are actuated by other cams.

With such an arrangement it is essential to ensure that the control arm and the output member of the governor mechanism are correctly set relative to each other to ensure that the correct amount of fuel is supplied to the engine and where a number of pumps are involved, that each pump supplies the same amount of fuel to the respective engine cylinder. In order to facilitate the setting procedure it is required to be able to set the control arm of the associated plunger and therefore the plunger, at a known angular position relative to the axis of the body. Such a position can for example be the maximum fuel position this being determined during testing of the pump following its manufacture.

Various ways of setting the plunger relative to the body are known. For example, it is known to provide a mark on the body with which the control arm can be aligned. This requires that the mark and the control arm should be visible after the pump has been assembled to the engine and this may require the provision of an access panel on the engine and is therefore not always practical. Another method is to use a set screw mounted on the body, which can engage with the control arm or vice versa. The difficulty here lies in the fact that the hole for the set screw has to be drilled and tapped and furthermore the screw must also be secured once the pump has been tested, against rotation. Moreover, following assembly of the pump to an engine, the screw has to be released to allow movement of the control arm.

The object of the invention is to provide a pump of the kind specified in a simple and convenient form.

According to the invention a pump of the kind specified comprises an arcuate member which can be adjustably secured on a cylindrical surface defined on the body, said arcuate member defining an edge for engagement by the control arm to set the control arm and plunger at a predetermined position about the axis of the plunger.

An example of a pump in accordance with the invention will now be described with reference to the accompanying drawings in which.

Figure 1:
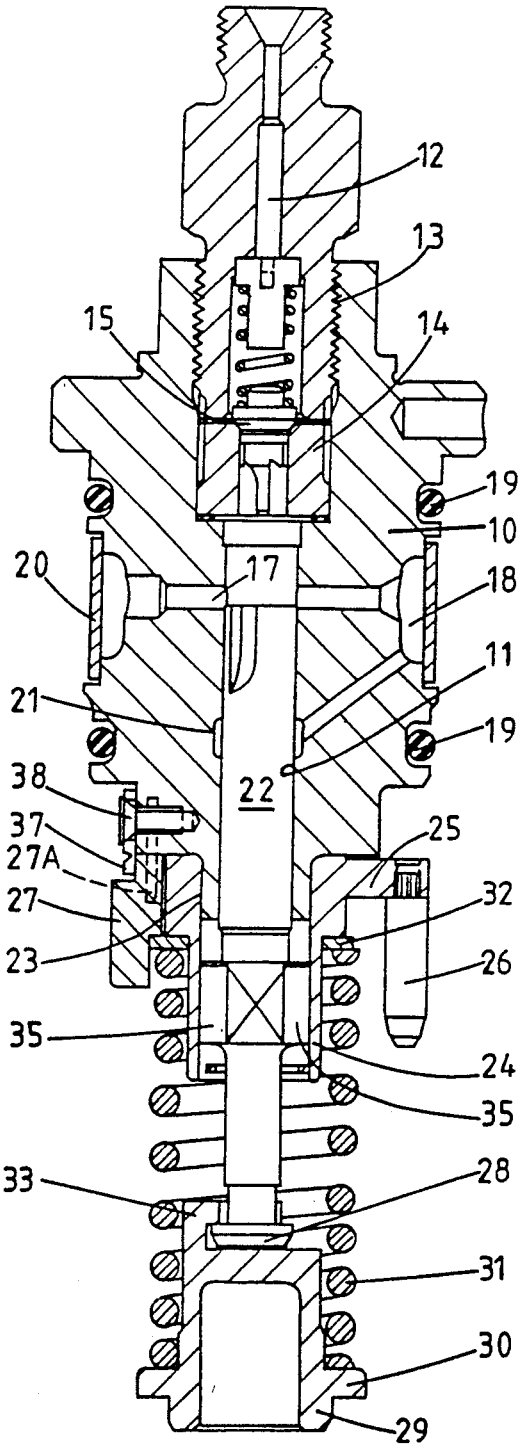
FIG. 1 is a sectional side elevation of the pump.

Referring to the drawings the pump comprises a generally cylindrical stepped body 10 in which is defined a bore 11. One end of the bore is closed by an outlet union which is screwed into a threaded recess 13 which forms a continuation of the bore 11 but is of enlarged diameter. The union retains in position against the step defined between the bore and the recess, a delivery valve body 14 which slidably accommodates a delivery valve 15 of conventional construction and the outlet union defines an outlet 12 from the one end of the bore.

Formed in the wall of the bore are a pair of diametrically disposed ports 17 which communicate by way of respective passages, with a circumferential groove 18 formed in the periphery of the body. On opposite sides of the groove 18 are further grooves which accommodate seal rings 19 respectively and partly closing the groove 18 is an anti-erosion ring 20 in which is formed an aperture conveniently displaced from the ports 17. In addition, there is defined in the bore a circumferential groove 21 which is also in communication with the groove 18.

Slidable within the bore is a plunger 22 which extends beyond the other end of the bore and the plunger in known manner, defines an inclined control edge which during inward movement of the plunger, after the end of the plunger has covered the ports 17, can uncover one of the ports 17 to permit fuel to escape from the bore.

Figure 3:
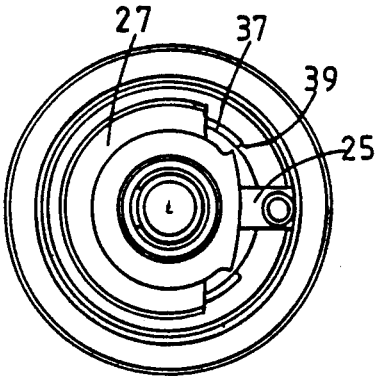
FIG. 3 is an underside view of the pump.

Rotatably mounted about a tubular portion 23 of the body is a flanged sleeve 24 from which extends an integral control lever 25 mounting a pin 26. As will be seen from FIG. 3, the lever 25 is located in a cut-away portion of an annular member 27 so that the lever and the sleeve 24 can be moved angularly about the axis of the plunger and the bore. The annular member 27 is engaged with the body 10 of the pump but is retained against angular movement, by means of a retaining pin 27A.

The plunger is provided with an enlarged foot 28 upon which is mounted a spring abutment 29 having a flange 30 which is engaged by one end of a spring 31 the opposite end of which bears against a shim 32 disposed adjacent the flange of the sleeve 24 and a step defined in the internal peripheral surface of the annular member 27. The abutment 29 has a hook portion 33 which engages over the foot 28. The abutment 29 which bears against the foot 28 will be actuated directly by an engine driven cam in which case the abutment carries a thrust member or indirectly by way of a rocker in which case the abutment will carry a suitably modified thrust member.

The plunger is also provided with outwardly extending projections or tongues 35 which are slidably accommodated within slots formed in the internal surface of the sleeve 24 and in order to prevent the plunger falling out of the bore and the sleeve, the latter is provided with a circlip which is located in a groove formed on the internal surface of the sleeve, the circlip interfering with at least one of the tongues 35 to prevent the plunger falling out of the bore in transit.

In the use of the pump the pump body is located within a recess formed in the cylinder head or crankcase of the engine, the recess having a passage leading into it through which fuel can flow to the circumferential groove 18. The sealing rings 19 on the opposite sides of the groove 18 prevent escape of fuel from the aforesaid recess.

The pump operates in a conventional manner. During inward movement of the plunger fuel escapes from the one end of the bore and through the ports 17 until the latter are covered by the plunger whereafter fuel is delivered past the delivery valve until such time as the inclined edge on the plunger uncovers the one port 17. The remaining fuel contained in the bore and which is displaced by the plunger is returned to the groove 18. During outward movement of the plunger fuel flows into the bore when the ports 17 are uncovered by the end of the plunger.

Figure 2:
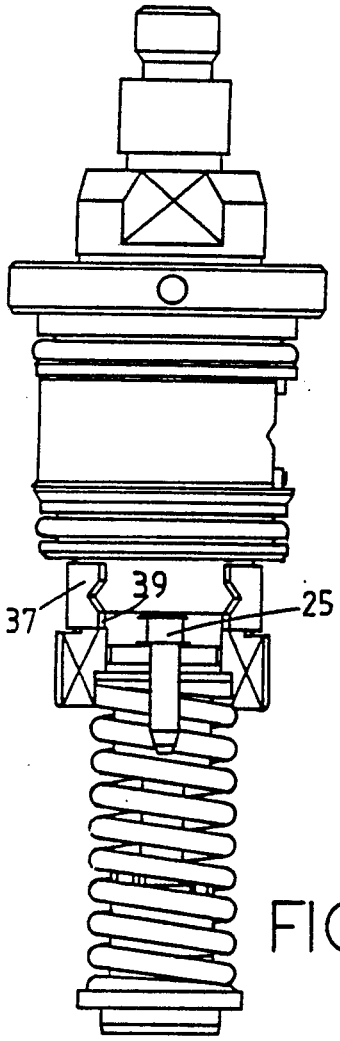
FIG. 2 is a side elevation taken at right angles to FIG. 1.

In order to be able to set the plunger at a predetermined angular position during assembly of the pump to an engine, there is provided an arcuate member in the form of a spring clip 37 which partially embraces a cylindrical portion of the body 10. As will be seen from FIG. 1, a screw 38 is provided to retain the clip in position, the clip defining a circumferential slot to receive the head of the screw and to permit adjustment of the clip. As more clearly seen in FIGS. 2 and 3, the clip defines an edge 39 which lies in the path of movement of the control arm 25. In the process of testing the pump following assembly, the control arm is set to a position corresponding to a known pump output say maximum fuel and then the clip is moved angularly so that the edge 39 engages the arm 25. Following this the screw 38 is tightened.

During assembly of the pump into the engine, the arm 25 is moved into engagement with the edge 39 so that the plunger assumes the known angular setting relative to the body. The construction as described is particularly simple and although a tapped hole is required for the screw 38, the hole extends in a radial direction and is therefore easier to drill then for example if the adjusting screw were provided on the skirt portion or the lever 25.

Figure 4:
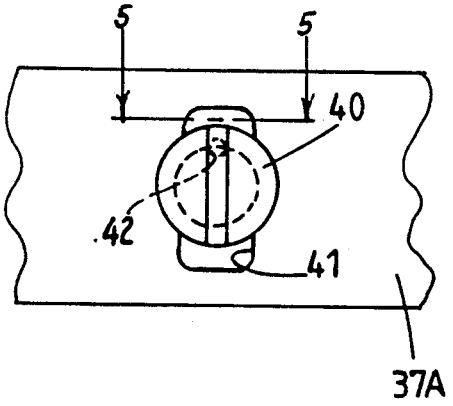
FIG. 4 is an elevation showing a portion of a modified clip and adjustable positioning member.
Figure 5:
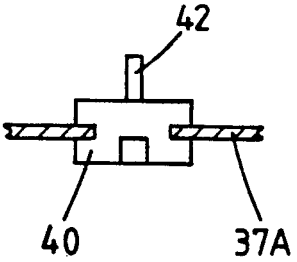
FIG. 5 is a section view taken on line 5—5 of FIG. 4.

Furthermore, as shown in FIGS. 4 and 5, the clip 37A can mount an angularly adjustable member 40 from which extends an eccentrically disposed pin 42 which is located in a hole formed in the pump body 10 (such as the hole for the screw 38 of the previously described embodiment). The adjustable member 40 is located within a slot 41 formed in the clip 37A and it can be locked in position to retain the clip once the position of the clip has been set by angularly moving the adjustable member 40.

I claim:

1. A fuel injection pump for supplying fuel to an internal combustion engine comprising a pump body, a bore defined therein and an outlet from one end of the bore, a pumping plunger slidable in the bore and extending from the other end thereof, a spill port formed in the wall of the bore and an inclined control edge formed on the plunger, a fuel control arm extending laterally from the pump body, the arm being angularly adjustable about the axis of the plunger, means coupling the arm to the plunger whereby the angular setting of the plunger can be adjusted, resilient means biasing the plunger in the direction away from said one end of the bore, and an arcuate member which can be adjustably positioned on and secured directly to a cylindrical surface on the pump body, said arcuate member defining an edge for engagement by the control arm to set the control arm and the plunger at a predetermined position about the axis of the plunger.

2. A pump according to claim 1, in which said arcuate member comprises a spring clip, the clip being retained in position by a retaining device engaged with the pump body, the clip defining a circumferential slot to receive the device to enable adjustment of the clip prior to tightening the device.

3. A pump according to claim 1, in which said arcuate member comprises a spring clip, the clip mounting an angularly adjustable member which carries an eccentrically disposed pin engaged in a hole formed in the pump body.

* * * * *